US006247956B1

(12) United States Patent
Porter, Jr.

(10) Patent No.: US 6,247,956 B1
(45) Date of Patent: Jun. 19, 2001

(54) QUICK CONNECT AND QUICK DISCONNECT CABLE CONNECTOR ASSEMBLY

(75) Inventor: Frank Kendall Porter, Jr., Billerica, MA (US)

(73) Assignee: Tensolite Company, Andover, MA (US)

( * ) Notice: Subject to any disclaimer, the term of this patent is extended or adjusted under 35 U.S.C. 154(b) by 0 days.

(21) Appl. No.: 09/405,047

(22) Filed: Sep. 27, 1999

(51) Int. Cl.[7] ..... H01R 13/627
(52) U.S. Cl. ..... 439/352; 439/281
(58) Field of Search ..... 439/350, 352, 439/357, 281, 282, 283

(56) References Cited

U.S. PATENT DOCUMENTS 3,885,851 * 5/1975 Bennett ..... 439/352
3,945,701 * 3/1976 Boeke et al. ..... 439/281
5,192,219 * 3/1993 Fowler et al. ..... 439/350

* cited by examiner

*Primary Examiner*—Brian Sircus
*Assistant Examiner*—Javaid Nasri

(74) *Attorney, Agent, or Firm*—Herbert L. Bello

(57) ABSTRACT

A quick connect and quick disconnect connector assembly for connecting with a mating connector comprises a body and an engagement means. A retaining means is provided for securing the engagement means to the body. The engagement means includes an inner gripping member that is telescopically received in an outer actuation member. The inner gripping member has an outer wall surface that is formed with a first ramp portion and the outer actuation member has an inner wall surface that is formed with a second ramp portion, the first ramp portion being complementary to the second ramp portion. The first ramp portion of the outer wall surface of the inner gripping member is configured to interferingly engage and cooperate with the second ramp portion of the inner wall surface of the outer actuator member. The first ramp portion of the inner gripping member is formed with resilient fingers that are movable between a relaxed state and an inwardly urged state. The resilient fingers of the inner gripping member are moved inwardly from the relaxed state to the inwardly urged state for gripping engagement with the complementary connector when the second ramp portion is urged against the first ramp portion. The inner gripping member is moved outwardly from the inwardly urged state for disengagement with the complementary connector when the second ramp portion is moved away from the first ramp portion.

19 Claims, 4 Drawing Sheets

QUICK CONNECT AND QUICK DISCONNECT CABLE CONNECTOR ASSEMBLY

BACKGROUND OF THE INVENTION

1. Field of the Invention

The present invention relates to electrical connectors and, more particularly, is directed towards a releasable and replaceable quick connect and quick disconnect apparatus for electrical connectors.

2. Description of the Prior Art

Electrical applications require connector assemblies capable of coupling both wire and cable with minimal detriment to electrical efficiency and signal transmission.

A wide variety of connector assemblies are currently available in the prior art. Several currently available connector assemblies permit the fast and efficient connection and disconnection of sections of wire and cable substrates. Typically, these assemblies utilize threaded, or spring-loaded, mating components. In order to utilize these connector assemblies, mating connectors are brought into alignment and the juxtaposed mating components are then screwed, or latched, together. The process of threading or latching is reversed in order to separate the sections of the wire or cable substrate.

Although effective in most applications, currently available connector assemblies frequently suffer from two primary limitations. First, the threading and latching systems typically utilized by these assemblies can be difficult to manipulate in a confined area. For example, the limited space of a junction box or closely stacked electronic boards can make accurate alignment, and subsequent manipulation of a threaded, or spring-loaded, system extremely difficult. Second, threaded and spring-loaded systems are susceptible to becoming loosened, or even disconnected, due to exposure to external vibration. To counteract these limitations, some connector assemblies include a locking system associated with the threaded or spring-loaded systems. Although effective, this additional locking system can increase even further the problems associated with manipulation of the entire connector assembly.

A need exists for an improved apparatus that does not suffer from the limitations and disadvantages of prior devices. In particular, a need exists for an improved wire or cable connector assembly that can be quickly engaged and released.

SUMMARY OF THE INVENTION

It is an object of the present invention to provide a connector assembly which does not suffer from the foregoing disadvantages and limitations.

It is another object of the invention to provide an apparatus and method that can be used with a variety of wire or cable connectors.

It is yet another object of the invention to provide an apparatus for interconnecting wire or cable that is simple in construction and compact in design.

It is yet another object of the present invention to provide an apparatus for interconnecting wire or cable that is easily and economically produced, and readily assembled.

Other general and specific objects of the invention will in part be obvious and will in part appear hereinafter.

The invention is generally characterized by a connector assembly having a body, an engagement element, and a retaining element. The engagement element includes an inner gripping element having a ramp portion on an outer surface thereof and an outer actuation element having a ramp portion on an inner surface thereof. The inner gripping element is telescopically received in the outer actuation element. The ramp portion of the inner gripping element and the ramp portion of the outer actuation element are complementary and in juxtaposition to one another. The retaining element rotatably secures the inner gripping element on the body.

The body is configured to be removably and releasably connected to a complementarily configured mating connector assembly. The body includes a first end configured to rotatably receive the engagement element and a second end affixed to a given wire or cable substrate. The first end of the body typically includes a groove that is sized and shaped to receive the retaining element described in detail below. Both the first end and the second end of the body typically have a cylindrical cross-sectional configuration. Cylindrical cross-section configurations for the ends of the body are desired as they facilitate securing the engagement element, or wire or cable substrate, to the body.

The inner gripping element of the engagement element has a first open end and a second open end joined by a passage. The passage joining the first open end to the second open end is defined by a series of four inner wall surfaces. The passage generally includes a groove which is configured to receive at least a portion of the retaining element. The inner wall surfaces of the passage are all coaxially and concentrically aligned along an axis. An outer wall surface defines the exterior of the inner gripping element. The ramp portion of the outer wall surface of the gripping element is configured so as to be capable of interferingly engaging the ramp portion formed in the inner wall surface of the outer actuation element. The inner gripping element typically includes a series of flexible fingers or tang elements. The inner gripping element is typically manufactured from polytetrafluoroethylene (PTFE), commonly known as Teflon.

The outer actuation element of the engagement element is configured to telescopically receive the inner gripping element. The inner gripping element is captively held in the outer actuation element and is constrained for slidable and rotatable movement relative to the outer actuation element. The outer actuation element has a first open end and a second open end joined by a passage. This passage is also defined by a series of inner wall surfaces. In order to facilitate interfering engagement of the outer actuation element with the inner gripping element, the inner wall surfaces of the outer actuation element include at least one ramp portion that is complementary to the ramp portion of the outer wall surface of the inner gripping element. Movement of the ramp portion on the outer actuation element relative to the ramp portion on the inner gripping element forces the flexible tang elements inwardly. The outer actuation element also includes an outer wall surface having a series of ridges and grooves which define a purchase for moving the outer actuation element. The outer actuation element can be manufactured from virtually any high strength metallic, plastic, or composite material exhibiting the desired mechanical strength characteristics.

The retaining element secures the inner gripping element of the engagement element to the body, the outer actuation element being captively held to the inner gripping element. The retaining element has an inner portion and an outer portion. The inner portion of the retaining element is positioned in the groove formed in the body. The outer portion of the retaining element is received in the groove formed in the inner gripping element of the engagement element. In the preferred embodiment of the invention, the retaining element has a rectilinear cross-sectional configuration. Depending upon the application in which the connector assembly of the invention is to be utilized, the retaining element can be formed from either a metal substrate or an elastically deformable substrate.

The invention also contemplates a method of attaching, and detaching, the connector assembly of the invention from a mating connector assembly.

To attach the connector assembly of the invention to a mating connector assembly, the outer actuation element is first moved rearwardly over the inner gripping element, the ramp portions of the actuation element and the gripping element being juxtaposed substantially in space registration. The mating connector assembly is then inserted into the passage of the inner gripping element. Next, the outer actuation element is moved forwardly relative to the inner gripping element. As a result of this movement, the ramp portion of the outer actuation element is slidably urged against the ramp portion of the inner gripping element, thereby moving the tang elements inwardly into gripping contact with the outer surface of the mating connector assembly. Forward movement of the outer actuation element over the inner gripping element is curtailed when the tang elements are in substantially complete surface-to-surface contact with the outer surface of the mating connector assembly.

To release the connector assembly of the invention from the mating connector assembly, the outer actuation element is moved rearwardly relative to the ramp portion of the gripping element. Thus, the ramp portion of the actuation element is moved out of engagement with the ramp portion of the gripping element. The tang elements move upwardly and disengage the mating connector assembly. The mating connector assembly is then removed from the passage of the inner gripping element in order to separate the connector assembly of the invention from the mating connector assembly.

The invention accordingly comprises the steps and apparatus embodying features of construction, combinations of elements and arrangements of parts adapted to affect such steps, as exemplified in the following detailed disclosure, the scope of the invention being indicated in the accompanying claims.

BRIEF DESCRIPTION OF THE DRAWINGS

A fuller understanding of the nature and objects of the present invention will become apparent upon consideration of the following detailed description taken in connection with the accompanying drawings in which.

DETAILED DESCRIPTION OF THE PREFERRED EMBODIMENTS

Figure 1:
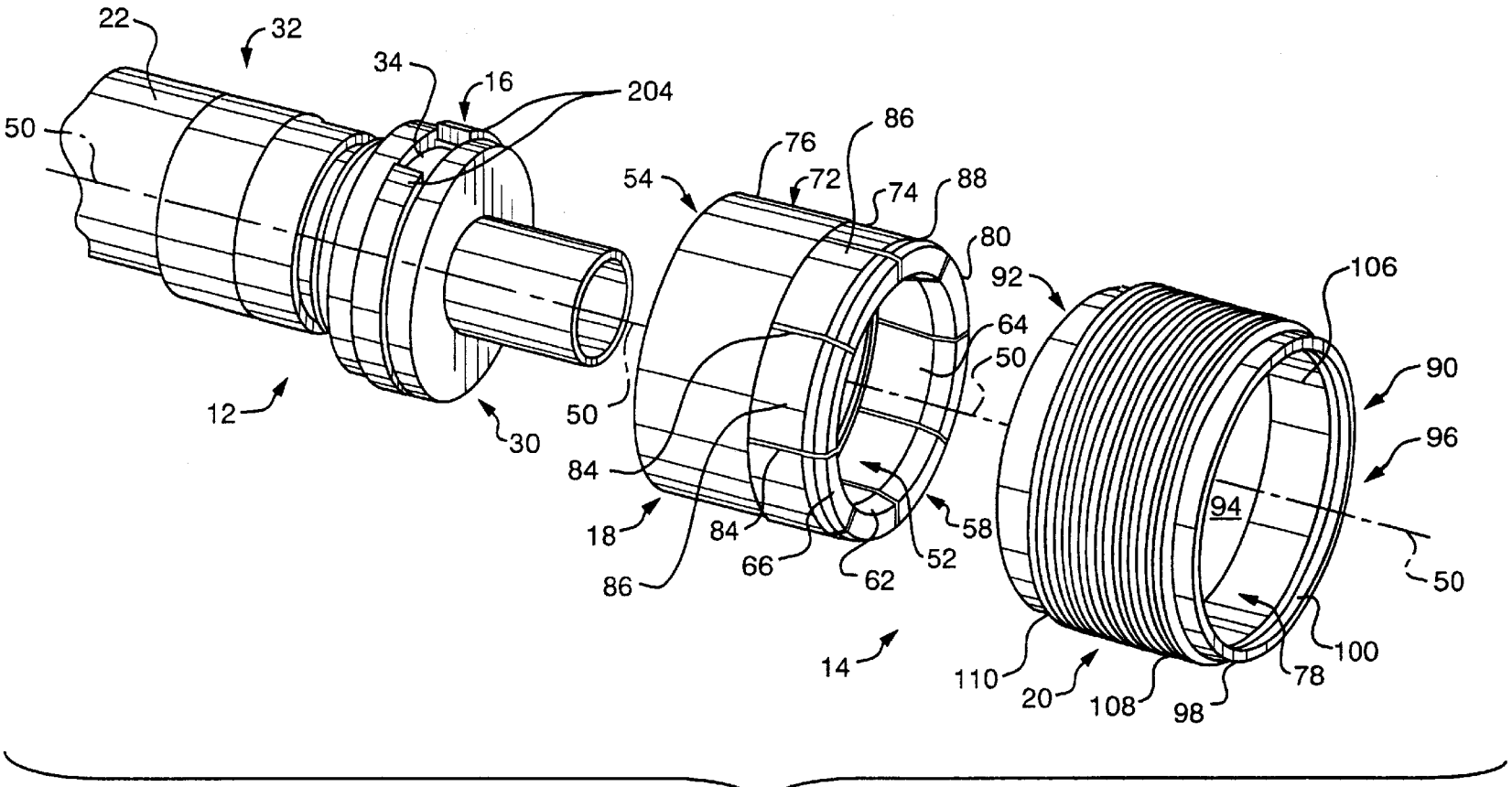
FIG. 1 is a perspective, exploded view of the connector assembly of the invention.

Referring now to the drawings, particularly FIGS. 1 through 4, there is shown a connector assembly 10 embodying the invention. The connector assembly 10 generally includes a body 12, an engagement element 14, and a retaining element 16. The engagement element 14 includes an inner gripping element 18 that is telescopically received in an outer actuation element 20. The inner gripping element 18 is captively held in the outer actuation element 20 and constrained for slidable movement relative thereto. The body 12 provides a terminus for a wire or cable substrate 22 upon which the connector assembly 10 is positioned. The retaining element 16 rotatably secures the inner gripping element 18 of the engagement element 14 on the body 12. The outer actuation element 20 is captively held on the inner gripping element 18. The engagement element 14 provides a means for mechanically coupling the connector assembly 10 to a complementarily configured mating connector assembly 24.

The body 12 has a first end 30 and a second end 32. As best shown in FIG. 1, the first end 30 is configured to be removably and releasably connected to the complementarily configured mating connector assembly 24. The second end 32 is affixable to the wire or cable substrate 22. Typically, the body 12 is manufactured from a metal substrate, however, virtually any material having the desired electrical conductivity properties and mechanical strength may be employed.

The first end 30 provides a connectable and disconnectable terminus to the wire or cable substrate 22. The first end 30 of the body 12 includes a groove 34 that is sized and shaped to receive the retaining element 16 described in detail below. The first end 30 of the body 12 typically has a cylindrical cross-sectional configuration. This configuration is desired as it facilitates rotatably securing the engagement element 14 in position on the body 12 in the manner described in detail below. Typically, as shown in the several FIGURES, the first end 30 of the body 12 is sized and shaped in the form of a male connector that is configured to be connected to a complementarily configured female mating connector assembly 24. Those skilled-in-the-art will appreciate, however, that the first end 30 can be either a male configuration or a female configuration depending upon the requirements of a given application.

As noted above, the second end 32 is affixable to the wire or cable substrate 22. Typically, the second end 32 has a cylindrical cross-sectional configuration. This configuration for the second end 32 is selected in order to complement the generally cylindrical cross-sectional configuration of the wire and cable substrate 22 upon which the connector assembly 10 is typically positioned. Those skilled-in-the-art will appreciate, however, that the second end 32 of the body 12 can have virtually any cross-sectional configuration depending upon the wire or cable substrate 22 to which it is attached.

The engagement element 14 is, preferably, rotatably secured on the body 12 by the retaining element 16 described in detail below. The engagement element 14 typically provides an encasement for at least a portion of the first end 30 of the body 12. As noted above, the engagement element 14 includes the inner gripping element 18 and outer actuation element 20, the inner gripping element being telescopically received in the outer actuation element. In the illustrated embodiment, the inner gripping element 18 and outer actuation element 20 are tubular elements that have a generally annular configuration and extend longitudinally along an axis 50.

The inner gripping element 18 has a first open end 52 and a second open end 54. A passage 56 joins the first open end 52 to the second open end 54. For the reasons set forth below, those skilled-in-the-art will appreciate that the inner gripping element 18 is preferably manufactured from a deformable, resilient material. Preferably, the inner gripping element 18 is manufactured from polytetrafluoroethylene (PTFE), commonly known as Teflon.

Figure 2:
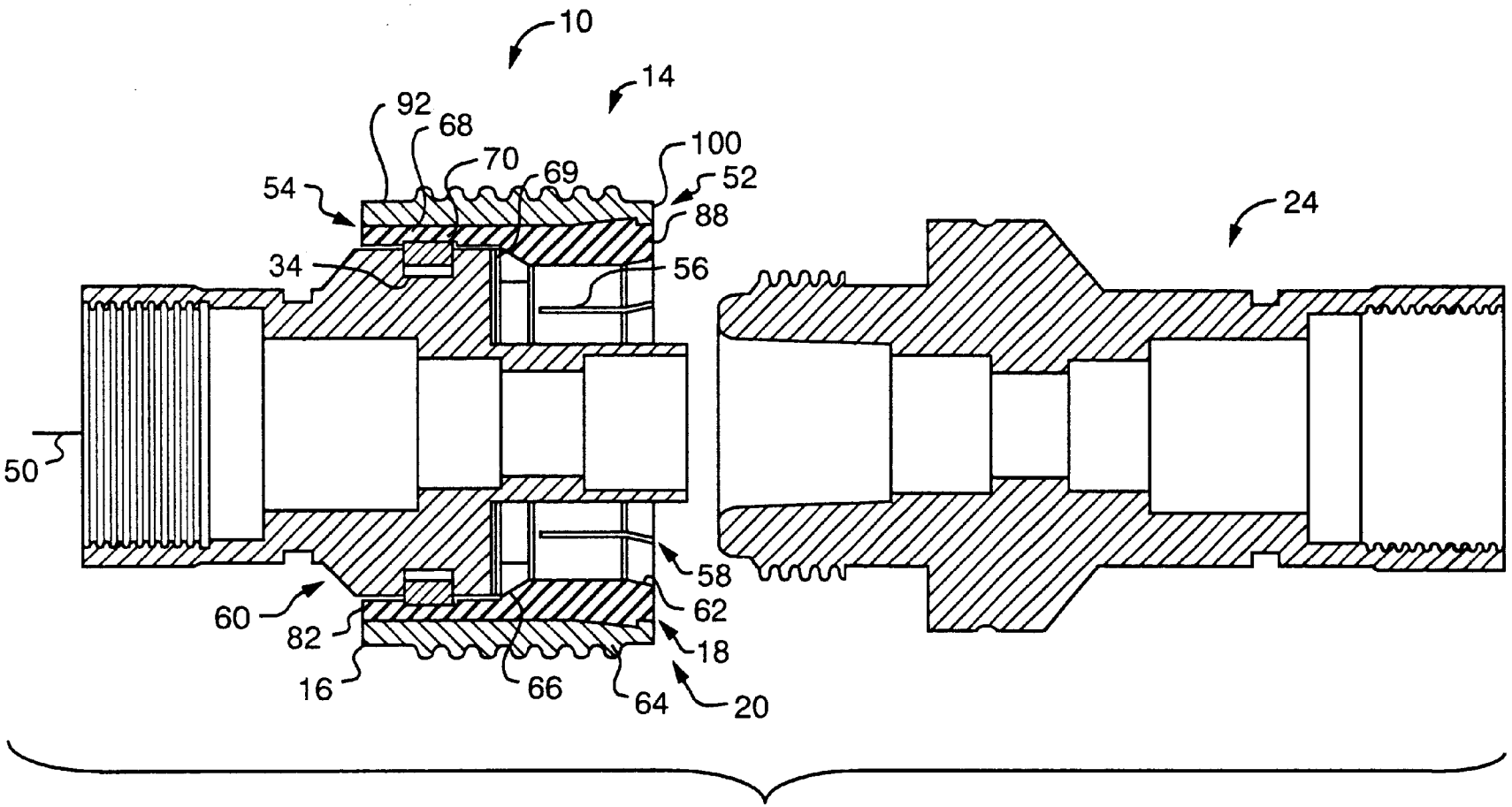
FIG. 2 is a side view of the connector assembly of the invention with a mating connector assembly separated therefrom.
Figure 3:
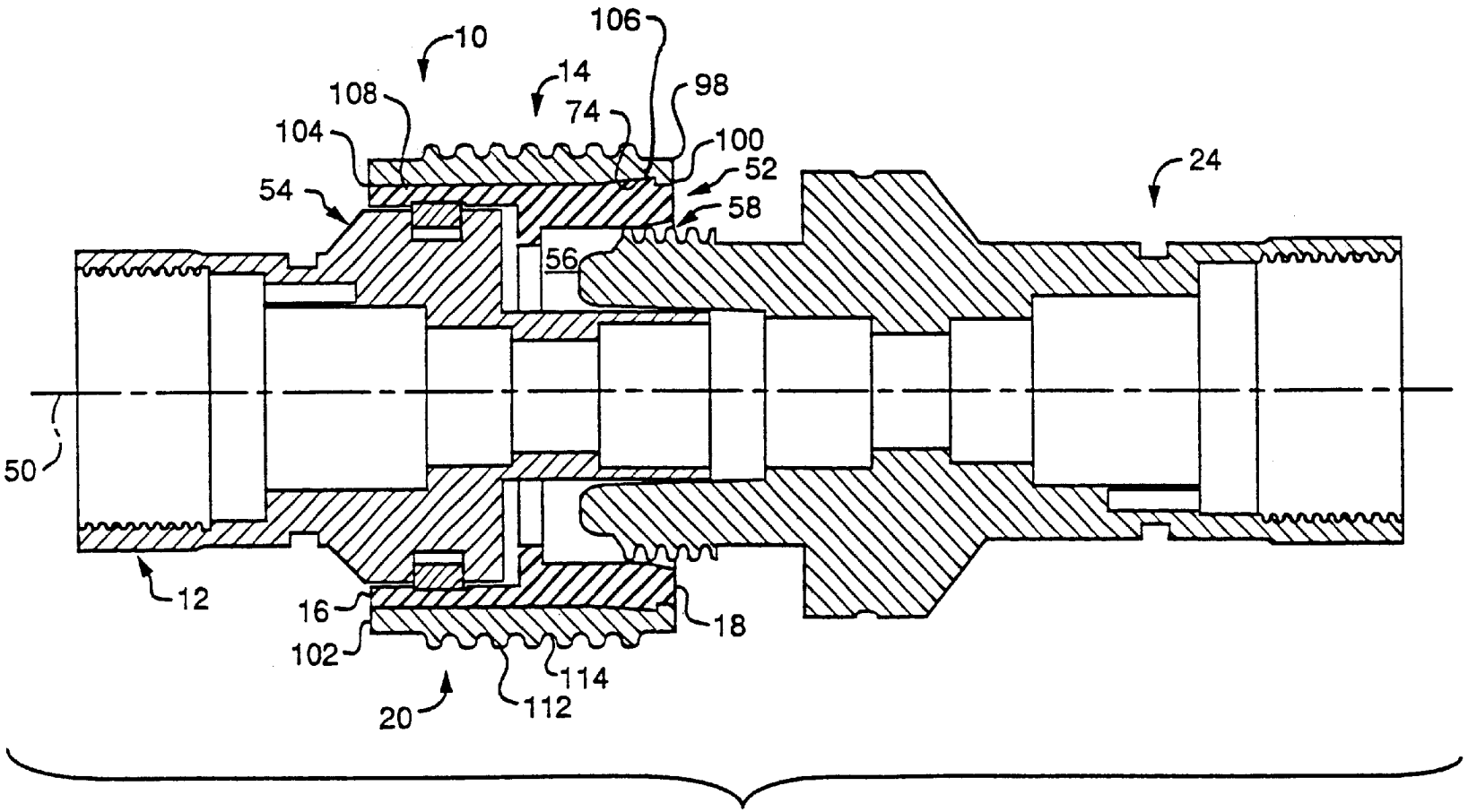
FIG. 3 is a side view of the connector assembly of the invention with a mating connector assembly partially positioned in the passage of the inner gripping element; and, FIG. 4 is a side view of the connector assembly of the invention with a mating connector assembly fully positioned in the passage of the inner tubular passage and the tang elements of the inner gripping element in contact with the outer surface of the mating connector assembly.
Figure 4:
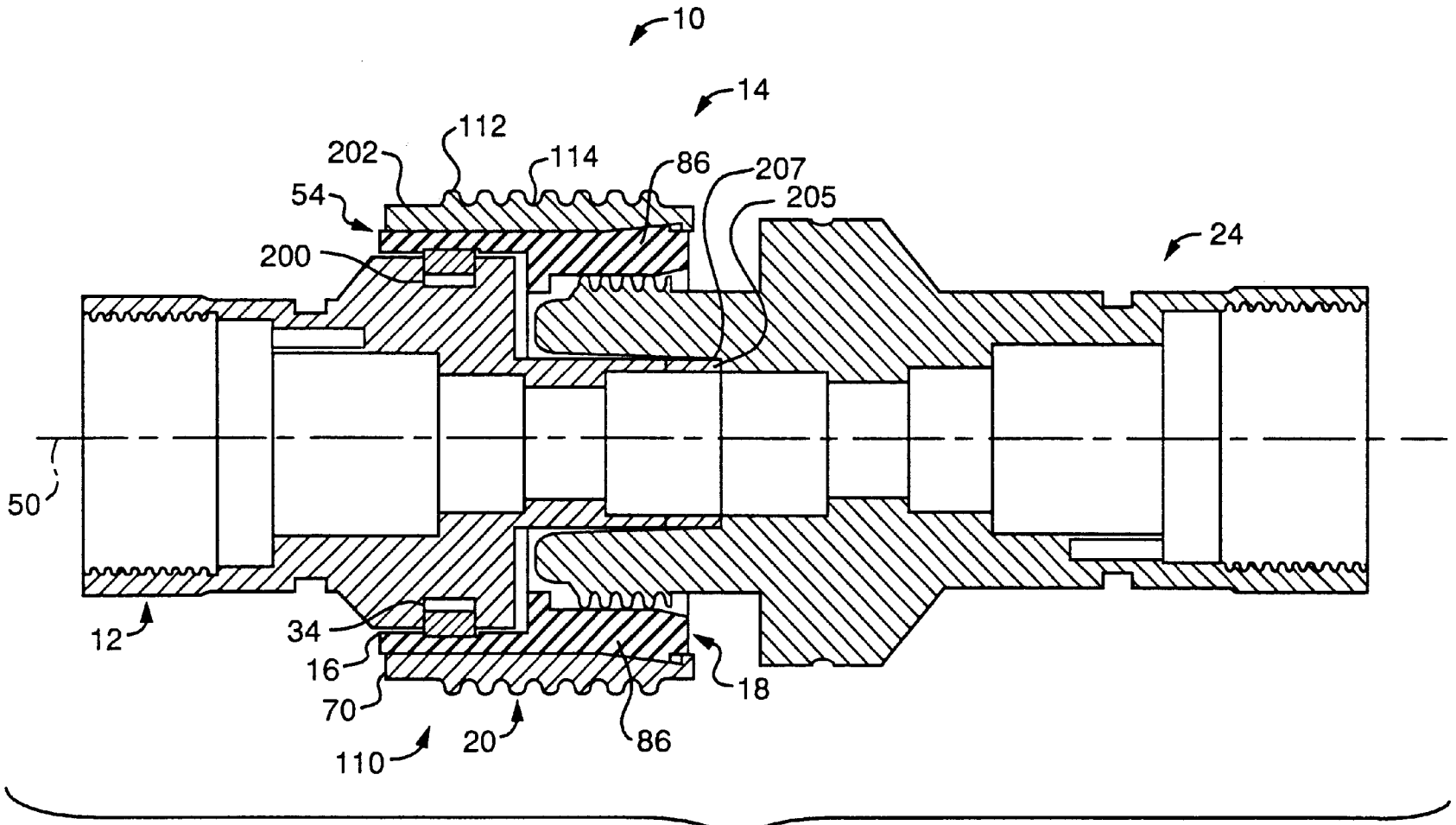

As shown in FIGS. 2 through 4, the first open end 52 is configured to receive the mating connector assembly 24 upon which the connector assembly 10 is positioned during use. Accordingly, the first open end 52 has an opening 58 that is sized and shaped to receive the mating connector assembly 24. An edge element 80 defines the opening 58 of the first open end 52. A groove 88 is formed in the edge element 80 along the exterior circumference thereof. In the preferred embodiment of the invention as shown in the several FIGURES, the opening 58 has a generally circular cross-sectional configuration. Those skill-in-the-art will appreciate, however, that the opening 58 can have virtually any cross-sectional configuration providing the selected configuration permits interconnection of the connector assembly 10 with the desired mating connector assembly 24.

The second open end 54 is configured to receive a portion of the body 12. The second open end 54 is defined by an edge element 82. More particularly, the second open end 54 has an opening 60 that is sized and shaped to receive the first end 30 of the body 12. In the preferred embodiment of the invention, the opening 60 has a generally circular cross-sectional configuration. Those skill-in-the-art will appreciate, however, that the opening 60 can have virtually any cross-sectional configuration providing the selected configuration permits interconnection of the engagement element 14 with the body 12.

The passage 56 joining the first open end 52 to the second open end 54 is defined by a series of inner wall surfaces. More particularly, the passage 56 is defined by four inner wall surfaces, i.e., first forward inner wall surface 62, second forward inner wall surface 64, flange element 66, and rear inner wall surface 68. The inner wall surfaces 62, 64, and 68, and flange element 66, are all coaxially and concentrically aligned along the axis 50.

The first forward inner wall surface 62 typically has a selected frusto-conical cross-sectional configuration. The cross-sectional dimension created by opposing sides of the first forward inner wall surface 62 is greater at a position proximate to the opening 58 than at a location distal to the opening 58. The angle between opposing sides of the first forward inner wall surface 62 is selected so as to provide an enlarged entranceway at the first open end 52 without sacrificing the mechanical strength and durability required of the engagement element 14. In operation, the first forward inner wall surface 62 serves to receive and align the mating connector assembly 24 with the first end 30 of the body 12.

The second forward inner wall surface 64 is integral with the first forward inner wall surface 62. The second forward inner wall surface 64 has a substantially cylindrical configuration. The second inner wall surface 64 is sized and shaped to guide the mating connector assembly 24 into connector assembly 10. Accordingly, in the preferred embodiment of the invention the cross-sectional dimension of the section formed by the second forward inner wall surface 64 is typically selected so as to be complementary to and slightly larger than the outer dimension of the mating connector assembly 24.

Integral with the second forward inner wall surface 64 is the flange element 66. The flange element 66 extends radially into the passage 56. The flange element 66 typically functions to retain a spring element 69, for example a spring washer, that biases engagement element 14 and removes any free play between the body 12 and the engagement element 14.

The final portion of the passage 56 is defined by the rear inner wall surface 68. The rear inner wall surface 68 is configured to receive at least a portion of the first end 30 of the body 12. Preferably, the rear inner wall surface 68 includes a groove 70 that is sized and shaped to receive the retaining element 16 described in detail below. Preferably, the groove 70 is positioned such that when the connector assembly 10 is fully assembled as shown in FIGS. 2 through 4, the groove 70 and the groove 34 are coaxially and concentrically aligned so that both can cooperatively receive the retaining element 16.

An outer wall surface 72 defines the exterior of the inner gripping element 18. The outer wall surface 72 includes a first portion 74 and a second portion 76. The first portion 74 is proximate to the first open end 52. The second portion 76 is proximate to the second open end 54. The length of the first portion 74 is between about one-third and about one-half of the length of the outer wall surface 72. The first portion 74 and second portion 76 are configured to interferingly receive the outer actuation element 20. More particularly, the first portion 74 and second portion 76 are configured to interferingly engage the inner wall surface 78 of the outer actuation element 20 in the manner described in detail below.

The first or ramp portion 74 has a selected frusto-conical cross-sectional configuration. The cross-sectional dimension created by opposing sides of the first portion 74 is greater at a position proximate to the opening 58 than at a location distal to the opening 58. The angle between opposing sides of the first portion 74 forms an inclined surface for the inner wall surface 78 of the outer actuation element 20 to bear against when the outer actuation element 20 is moved on and over the inner gripping element 18 during use.

The second portion 76 is integral with the first portion 74. The second portion 76 also has a selected frusto-conical cross-sectional configuration. The cross-sectional dimension created by opposing sides of the second portion 76 is greater at a position proximate to the first portion 74 than at a location distal to the first portion 74. The dimensions and angular displacement of the second portion 76 are distinct from those of the first portion 74. More particularly, the angle of inclination relative to the axis 50 is greater for the first portion 74 than for the second portion 76. This configuration creates a more gradual decrease in the cross-sectional dimension of the outer wall surface 72 over the length of the second portion 76 as compared to the decrease in cross-sectional dimension observed in connection with the first portion 74.

Typically, a series of slot elements 84 extend between the first and second inner wall surfaces 62 and 64 and the outer wall surface 72. The slot elements 84 function to create a series of fingers or tang elements 86 at the first portion 74 of the inner gripping element 18. Creation of the tang elements 86 serves to facilitate compression and flexure of the inner gripping element 18 as it is compressed and released by the outer actuation element 20 during use. Generally, the slot elements 84 extend from the edge element 80 to the flange element 66. Accordingly, the slot elements 84 have a length equivalent to between about one-third and about one-half of the overall length of the inner gripping element 18. Although a series of slots elements 84 are shown in the drawings, it is to be understood that, in alternate embodiments, there is only one or two or more slot elements, the slot element or slot elements permitting contraction of the inner gripping element 18 into gripping contact with the mating connector assembly 24.

The outer actuation element 20 has a first open end 90 and a second open end 92. A passage 94 joins the first open end 90 to the second open end 92. For the reasons set forth below, those skilled-in-the-art will appreciate that the outer actuation element 20 can be manufactured from virtually any high strength metallic, plastic, or composite material exhibiting the desired mechanical strength characteristics. Preferably, the outer actuation element 20 is manufactured from stainless steel.

As shown in the several FIGURES, the first open end 90 is configured to receive the inner gripping element 18 upon which the outer actuation element 20 is positioned during use. Accordingly, the first open end 90 has an opening 96 that is sized and shaped to receive the inner gripping element 18. That is, the opening 96 has a configuration complementary to the configuration of the outer wall surface 72 of the inner gripping element 18. An edge element 98 defines the opening 96 of the first open end 90. A flange element 100 extends radially inward from the edge element 98. In operation, the flange element 100 cooperates with the groove 88 of the edge element 80 to restrict rearward movement of the outer actuation element 20 on and over the inner gripping element 18.

The second open end 92 is also configured to receive the inner gripping portion 18. The second open end 92 is defined by an edge element 102. More particularly, the second open end 92 has an opening 104 sized and shaped to receive the second open end 54 of the inner gripping element 18. In the preferred embodiment of the invention as shown in the several FIGURES, the opening 104 has a generally circular cross-sectional configuration. Those skilled in the art will appreciate, however, that the opening 104 can have virtually any cross-sectional configuration providing the selected configuration permits placement of the inner gripping element 18 within the outer actuation element 20.

The passage 94 joining the first open end 90 to the second open end 92 is defined by a two inner wall surfaces. More particularly, the passage 94 is defined by a first inner wall surface 106 and a second inner wall surface 108. The inner wall surfaces 106 and 108 are coaxially and concentrically aligned along the axis 50.

The first inner wall surface 106 has a selected frusto-conical cross-sectional configuration that defines a ramp portion. The cross-sectional dimension created by opposing sides of the first inner wall surface 106 is greater at a position proximate to the opening 96 than at a location distal to the opening 96. The angle between opposing sides of the first inner wall surface 106 is selected so as to be complementary to the configuration of the first portion 74 of the outer wall surface 72. In operation, the first inner wall surface or ramp portion 106 bears against the first or ramp portion 74 of the outer wall surface 72 of the inner gripping element 18 as the outer actuation element 20 is moved in a forward direction on and over the inner gripping element 18. This action acts to press the tang elements 86 inwardly into gripping contact with the mating connector assembly 24 positioned in the passage 56. Rearward movement of the outer actuation element 20 relative to the inner gripping element 18 permits the tang elements 86 to flex upwardly and away from the surface of the mating connector assembly 24 positioned in the passage 56. This action permits the mating connector assembly 24 to be released from the connector assembly 10.

The second inner wall surface 108 is integral with the first inner wall surface 106. The second inner wall surface 108 also has a selected frusto-conical cross-sectional configuration. The cross-sectional dimension created by opposing second inner wall surface 108 is greater at a position proximate to the first inner wall surface 106 than at a location distal to the first inner wall surface 106. The dimensions and angular displacement of the second inner wall surface 108 are distinct from those of the first inner wall surface 106. More particularly, the angle of inclination relative to the axis 50 is greater for the first inner wall surface 106 than for the second inner wall surface 108. This configuration creates a more gradual decrease in the cross-sectional dimension of the passage 94 over the length of the second inner wall surface 108 as compared to the decrease in cross-sectional dimension observed in connection with the first forward inner wall surface 106.

In operation, the second inner wall surface 108 interferingly engages the second portion 76 of the outer wall surface 72 of the inner gripping connector 18. Accordingly, in the preferred embodiment of the invention the cross-sectional dimension of the frusto-conical section formed by the second inner wall surface 108 is selected so as to be complementary to the configuration of the second portion 76 of the outer wall surface 72.

An outer wall surface 110 defines the exterior of the outer actuation element 20. The outer wall surface 110 includes a series of ridges 112 and grooves 114. The ridges 112 and grooves 114 define a purchase for moving the outer actuation element 20. More particularly, the ridges 112 and grooves 114 provide a textured surface against which users can press, or pull, in order to manipulate the forward, or rearward, movement of the outer actuation element 20 on and over the inner gripping element 18.

The retaining element 16 rotatably secures the engagement element 14 to the first end 30 of the body 12. To accomplish this result, when the connector assembly 10 is fully assembled as shown in the several FIGURES, an inner portion 200 of the retaining element 16 is positioned in the groove 34 of the body 12 while an outer portion 202 is positioned in the groove 70 of the rear inner wall surface 68 of the engagement element 14. In order to facilitate positioning of the retaining element 16 in this way, the inner portion 200 of the retaining element 16 has a size and shape that is complementary to the configuration of the groove 34. The outer portion 202 of the retaining element 16 has a size and shape that is complementary to the configuration of the groove 70. In the preferred embodiment of the invention, the retaining element 16 has a rectilinear cross-sectional configuration.

The retaining element 16 can be formed from, for example, a metal substrate. When this type of substrate material is utilized to form the retaining element 16, the retaining element 16 typically has a discontinuous loop configuration. A typical configuration is in the shape of a "C" ring as shown in FIG. 1.

In order to position the retaining element 16 in the groove 34 of the first end 30 of the body 12, the ends 204 of the retaining element 16 are first brought into contact with the body 12 such that the ends 204 rest in the groove 34. A force normal to the axis 50 is then applied to the retaining element 16 so as to press the retaining element 16 onto the body 12. That is, the force presses the ends 204 on and over the surface of the body 12, separating them as they are moved in and through the groove 34. Once the retaining element 16 is fully positioned in the groove 34, i.e., the ends 204 move over the widest part of the body 12, the retaining element 16 relaxes and the ends 204 move back together.

In order to position and retain the engagement element 14 on the body 12, the retaining element 16 is first compressed so that the engagement element 14 can be slipped on and over the first end 30 of the body 12. When the groove 34 and the groove 70 are in alignment, the retaining element 16 is released and permitted to expand into the groove 70. The retaining element 16 is sized and shaped to be fit in groove 70. Expansion of the retaining element 16 affixes the engagement element 14 on the body 12 and completes the assembly process. The retaining element 16 is formed from an elastically deformable and resilient substrate, for example, metal or plastic. When these materials are utilized, the retaining element 16 typically is deformed in order to first position it within the confines of the groove 34. More particularly, the retaining element 16 preferably is expanded from a relaxed state to an expanded state. The retaining element 16 retains, however, a memory of its relaxed state and, thus, returns toward that state when captured in the groove 34. When these materials are employed, the retaining element 16 is sized and shaped such that when it is in its relaxed state it can be interferingly received on the first end 30 of the body 12.

In order to complete assembly, the engagement element 14 is pressed over the first end 30 of the body 12 until the retaining element 16 is positioned in the groove 70. Typically, the press fitting of the engagement element 14 onto the first end 30 of the body 12 is done concurrent with a circumferential compression of the retaining element 16 into the groove 34. Expansion of the retaining element 16, when the groove 34 and the groove 70 are in concentric and coaxial alignment, facilitates interconnection of the engagement element 14 and the body 12.

The invention also contemplates a method of attaching, and detaching, the connector assembly 10 from a mating connector assembly 24. The method of the invention is depicted in FIGS. 2 through 4.

As shown in FIG. 2, to attach the connector assembly of the invention 10 to a mating connector assembly 24, the outer actuation element 20 is first moved rearwardly over the inner gripping element until such time as the flange element 100 is in contact with the groove 88. As shown in FIG. 3, the mating connector assembly 24 is then moved into position in the passage 56. The mating connector assembly 24 is fully positioned in the passage 56 when an end 205 of the mating connector assembly 24 comes into proper mechanical and electrical conductivity contact with an end 207 of the connector assembly 10. Next, the outer actuation element 20 is moved forwardly on and over the inner gripping element 18. As shown in FIG. 4, this forward movement causes the tang elements 86 to come into interfering contact with the outer surface of the mating connector assembly 24. Forward movement of the outer actuation element 20 over the inner gripping element 18 is curtailed when the second forward inner wall surface 64 are in substantially complete surface-to-surface contact with the outer surface of the mating connector assembly 24. Preferably, the ramp portion 74 of the inner gripping element 18 and the ramp portion 106 of the actuation element 20 have a shallow taper and are in full surface-to-surface contact as the actuation element is moved forwardly. The shallow taper and full surface-to-surface contact result in a uniform and full compressive force being applied to mating connector assembly 24 by the tang elements 86.

To release the connector assembly 10 from a mating connector assembly 24, the outer actuation element 20 is moved rearwardly on and over the inner gripping element 18. This action permits the tang elements 86 to move upwardly and away from the outer surface of the mating connector assembly 24. Rearward movement of the outer actuation element 20 relative to the inner gripping element 18 continues until the flange element 100 is positioned in the groove 88. The mating connector assembly 24 is then removed from the passage 56 of the inner gripping element 18 in order to separate the connector assembly 10 from the mating connector assembly 24.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall there between.

What is claimed is:

1. A connector assembly, said connector assembly comprising:

a) a body;

b) an engagement means, said engagement means including an inner gripping member telescopically received in an outer actuator member, said inner gripping member having an outer wall surface that is formed with a first ramp portion, said outer actuator member having an inner wall surface that is formed with a second ramp portion, said first ramp portion complementary to said second ramp portion, said first ramp portion of said outer wall surface of said inner gripping member configured to interferingly engaging and cooperate with said second ramp portion of said inner wall surface of said outer actuator member, said inner gripping member having a relaxed state and an inwardly urged state, said inner gripping member being moved inwardly from said relaxed state to said inwardly urged state when one of said outer actuator member and said inner gripping member is moved in a first direction relative to the other of said outer actuator and said inner gripping member, said relative movement in said first direction causing said second ramp portion to be urged against and force said first ramp portion inwardly, said inner gripping member being moved outwardly from said inwardly urged state to said relaxed state when said outer actuator member is moved in a second direction relative to said inner gripping member said relative movement in said second direction permitting said second ramp portion to move outwardly, said second direction opposite said first direction; and c) a retaining means, said retaining means rotatably affixing said inner gripping member of said engagement means to said body.

2. The connector assembly of claim 1 wherein said first ramp portion is formed with at least two fingers that are movable from said relaxed state to said inwardly urged state when said second ramp portion is urged against said first ramp portion.

3. The connector assembly of claim 1 wherein said inner gripping member of said engagement means comprises an inner wall surface, said inner wall surface having a groove means configured to receive said retaining means.

4. The connector assembly of claim 1 wherein said inner gripping member further comprises a first end, a second end, and a passage, said passage extending between said first end and said second end.

5. The connector assembly of claim 4 wherein said passage in said inner gripping member is defined by a wall surface, said wall surface comprising a first wall surface and a second wall surface, said first wall surface being integral with said second wall surface, said first wall surface having a frusto-conical configuration defining an enlarged entrance-way.

6. The connector assembly of claim 5 wherein said wall surface of said passage further comprises a flange means, said flange means being integral with said second wall surface.

7. The connector assembly of claim 6 wherein said wall surface of said passage further comprises a rear wall surface, said rear wall surface being integral with said flange means.

8. The connector assembly of claim 1 wherein said body is formed with groove means that is configured to receive said retaining means.

9. A connector assembly, said connector assembly comprising:

a) a body, said body having a groove means;

b) an engagement means, said engagement means including an inner gripping member telescopically received in an outer actuator member, said inner gripping member and said outer actuator member being slidably movable relative to each other, said inner gripping member having an outer wall surface and an inner wall surface, said outer actuator member having an inner wall surface that is complementary to said outer wall surface of said inner gripping member, said outer wall surface of said inner gripping member having a first ramp portion, said inner wall surface of said actuator member having a second ramp portion, said first ramp portion and said second ramp portion being configured to interferingly engage each other, said inner wall surface of said inner gripping member having a groove means, said inner gripping member composed of a deformable and resilient material said inner gripping member having a relaxed state and an inwardly urged state, said inner gripping member being in said inwardly urged state when one of said outer actuator member and said inner gripping member is urged against the other of said outer actuator member and said inner gripping member, said inner gripping member being in said relaxed state when said outer actuator member is moved out of urged engagement with said inner gripping member; and c) a retaining means, said retaining means rotatably affixing said inner gripping member of said engagement means to said body, said retaining means being contained in said groove means of said body and said groove means of said inner gripping member when said groove means of said body and said groove means of said inner gripping member are concentrically and coaxially aligned.

10. The connector assembly of claim 9 wherein said first ramp portion is formed with at least two fingers that are movable from said relaxed state to said inwardly urged state when said second ramp portion is urged against said first ramp portion.

11. The connector assembly of claim 9 wherein said first ramp portion is formed with at least three fingers that are movable from said relaxed state to said inwardly urged state when said second ramp portion is urged against said first ramp portion.

12. The connector assembly of claim 9 wherein said inner wall surface of said outer actuator member comprises a first wall surface and a second wall surface, said first wall surface of said outer actuator member being integral with said second wall surface of said outer actuator member, said first wall surface of said outer actuator member having a frusto-conical configuration.

13. The connector assembly of claim 12 wherein said inner wall surface of said outer actuator member further comprises a flange means, said flange means of said outer actuator member being integral with said second wall surface of said outer actuator member.

14. The connector assembly of claim 9 wherein said retaining means is manufactured from a resilient material.

15. A connector assembly, said connector assembly comprising:

a) a body;

b) an engagement means, said engagement means including an inner gripping member telescopically received in an outer actuator member, said inner gripping member and said outer actuator member being slidably movable relative to each other, said inner gripping member having an outer wall surface that is formed with a force receiving ramp portion, said outer actuator member having an inner wall surface that is formed with a force exerting ramp portion, said force receiving ramp portion being complementary to said force exerting ramp portion, said force receiving ramp portion of said outer wall surface of said inner gripping member configured to interferingly engaging and cooperate with said force exerting ramp portion of said inner wall surface of said outer actuator member, said inner gripping member being composed of a deformable and resilient material, said inner gripping member having a relaxed state and an inwardly urged state, said inner gripping member being moved inwardly from said relaxed state to said inwardly urged state when said one of said force exerting ramp portion and said force receiving ramp portion is urged against the other of said force exerting and said force receiving ramp portions, said inner gripping member being moved outwardly from said inwardly urged state to said relaxed state when said force exerting ramp portion is moved away from said force receiving ramp portion; and c) a retaining means, said retaining means rotatably affixing said inner gripping.

16. The connector assembly of claim 15 wherein said force receiving portion is formed with at least one slot that permits movement of said inner gripping member to move from said relaxed state to said inwardly urged state when said force exerting portion is urged against said force receiving portion.

17. A method of interconnecting a first wire substrate with a second wire substrate, one of either of said first wire substrate or said second wire substrate having a mating connector assembly positioned thereon, said method comprising the steps of:

a) providing a connector assembly having a body, an engagement means, and a retaining means, said retaining means rotatably affixing said engagement means on said body, said engagement means including an inner gripping member and an outer actuator member, said inner gripping member telescopically received in said outer actuator member, said inner gripping member and said outer actuator member being slidable relative to each other, said inner gripping member having an outer wall surface, said inner gripping member having a longitudinally extending passage, said passage being defined by a wall means, said outer actuator member having an inner wall surface that is complementary to said outer wall surface of said inner gripping member, said outer wall surface of said inner gripping member interferingly engaging said inner wall surface of said outer actuator member, said inner gripping member having a relaxed state and an inwardly urged state;

b) positioning the mating connector assembly in the passage of said inner gripping member;

c) moving said outer actuator member on and over said inner gripping member so as to move said inner gripping member from said relaxed state to said inwardly urged state; and d) continuing to move said outer actuator member on and over said inner gripping member until said wall means of said passage deform and come into gripping contact with said mating connector assembly.

18. The method of claim 17 including the step of forming said inner gripping member with at least two fingers, said fingers movable between said relaxed state and said inwardly urged state, said fingers contacting and gripping said mating connector assembly.

19. The method of claim 17 comprising the further step of providing a connector assembly having a body with a groove means that is configured to receive said retaining means.

* * * * *